US007991316B2

(12) United States Patent
Kagawa

(10) Patent No.: US 7,991,316 B2
(45) Date of Patent: Aug. 2, 2011

(54) FIXING DEVICE

(75) Inventor: Tetsuya Kagawa, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 635 days.

(21) Appl. No.: 11/905,816

(22) Filed: Oct. 4, 2007

(65) Prior Publication Data

US 2008/0112720 A1 May 15, 2008

(30) Foreign Application Priority Data

Nov. 9, 2006 (JP) ..... 2006-303770

(51) Int. Cl.
*G03G 15/20* (2006.01)

(52) U.S. Cl. ..... 399/69; 399/67; 399/328; 399/330; 399/331; 347/156; 219/216

(58) Field of Classification Search ..... 399/69, 399/328, 67, 330, 331; 347/156; 219/216
See application file for complete search history.

(56) References Cited

U.S. PATENT DOCUMENTS

| | | | | |
|---|---|---|---|---|
| 4,511,778 | A * | 4/1985 | Takahashi et al. | 219/691 |
| 6,341,211 | B1 | 1/2002 | Tsujimoto et al. | |
| 6,498,324 | B2 * | 12/2002 | Yamamoto et al. | 219/602 |
| 7,203,439 | B2 * | 4/2007 | Sone et al. | 399/69 |
| 7,305,197 | B2 * | 12/2007 | Kinouchi et al. | 399/67 |
| 7,319,210 | B2 * | 1/2008 | Hosoi et al. | 219/619 |
| 7,386,243 | B2 * | 6/2008 | Kinouchi et al. | 399/69 |
| 7,486,923 | B2 * | 2/2009 | Imai et al. | 399/333 |
| 2003/0235423 | A1 * | 12/2003 | Ota | 399/69 |
| 2004/0240898 | A1 * | 12/2004 | Nonaka et al. | 399/33 |
| 2004/0265021 | A1 * | 12/2004 | Kinouchi et al. | 399/334 |
| 2006/0086725 | A1 * | 4/2006 | Hosoi et al. | 219/619 |
| 2006/0165444 | A1 * | 7/2006 | Nanjo et al. | 399/328 |
| 2006/0198672 | A1 * | 9/2006 | Kinouchi et al. | 399/334 |
| 2006/0210291 | A1 * | 9/2006 | Kinouchi et al. | 399/67 |
| 2006/0210330 | A1 * | 9/2006 | Sone et al. | 399/328 |
| 2007/0264061 | A1 * | 11/2007 | Nanjo et al. | 399/333 |
| 2008/0203088 | A1 * | 8/2008 | Kinouchi et al. | 219/619 |

FOREIGN PATENT DOCUMENTS

JP 09-050199 2/1997

(Continued)

OTHER PUBLICATIONS

Official Action in JP 2006-303770 dated Sep. 24, 2008, and English Translation thereof.

(Continued)

*Primary Examiner* — David P Porta
*Assistant Examiner* — Djura Malevic
(74) *Attorney, Agent, or Firm* — Buchanan Ingersoll & Rooney PC

(57) ABSTRACT

There is provided a fixing device 6 including a heating body 22 which has a heating heat generation section 24 subjected to induction heating upon application of alternating magnetic fields generated by a exciting coil 27, a pressure roller 23 which has a pressing heat generation section 25 being higher in magnetic permeability than the heating heat generation section 24 and being subjected to induction heating by a part of magnetic flux in the alternating magnetic fields leaking from the heating heat generation section 24, and a drive circuit for applying drive voltage to the exciting coil, wherein a rate of the alternating magnetic fields leaking from the heating heat generation section 24 is changed by frequencies of the drive voltage.

20 Claims, 9 Drawing Sheets

FOREIGN PATENT DOCUMENTS

| | | | |
|---|---|---|---|
| JP | 09-237675 | | 9/1997 |
| JP | 10-162944 | A | 6/1998 |
| JP | 2003-317923 | A | 11/2003 |
| JP | 2004-212918 | | 7/2004 |
| JP | 2005-115256 | | 4/2005 |
| JP | 2006-146188 | | 6/2006 |
| JP | 2006-259718 | | 9/2006 |

OTHER PUBLICATIONS

Notification of the First Office Action with English Translation, Chinese Application No. 200710168212.0, dated Sep. 4, 2009.

* cited by examiner

FIXING DEVICE

RELATED APPLICATION

The present invention is based on Patent Application No. 2006-303770 filed in Japan.

BACKGROUND OF THE INVENTION

The present invention relates to a fixing device for use in electrophotographic devices.

In electrophotographic devices, which are applied to copiers, printers, facsimiles and complex machines composed thereof, toners are fixed onto recording paper by transferring toner images on the recording paper and heating the recording paper while keeping the recording paper in between a heating body (heating roller or heating belt) and a pressing body (pressure roller or pressure belt).

In such fixing process, sufficient adhesive strength of toners to the recording paper is sometimes not achieved simply by heating a printing surface onto which toner images were transferred with a heating roller (or heating belt). Therefore, a heat source such as halogen lamps is generally placed inside each of the heating roller and the pressure roller (or heating belt).

As disclosed in JP H10-162944 A, U.S. Pat. No. 6,341,211 and JP 2003-317923 A, a technology for induction heating conducted by applying alternating magnetic fields to the heating roller is publicly known.

The induction heating requires placement of expensive exciting coils for applying alternating magnetic fields to heating elements, and placing the exciting coil in each of the heating roller and the pressure roller has imposed a heavy burden in terms of costs.

The technology disclosed in JP H10-162944 A is to provide an exciting coil extending through both a heating roller and a pressure roller so as to heat both the heating roller and the pressure roller with a single exciting coil. However, winding the exciting coil so as to alternatively go through the heating roller and the pressure roller is technically difficult to achieve and may adversely cause cost increase.

In U.S. Pat. No. 6,341,211, the frequency of a drive voltage applied to an exciting coil is controlled so as to allow downsizing of a closed magnetic circuit core, though the aspect of heating the pressure roller is not at all disclosed.

The technology disclosed in JP 2003-317923 A is to divide an exciting coil into a plurality of parts so as to constitute circuits having different resonance frequencies by resonant capacitors and to select an exciting coil to function by frequencies of drive voltages. However, this technology is to make a heating value of the heating roller appropriate and the aspect of heating the pressure roller is not at all disclosed.

SUMMARY OF THE INVENTION

An object of the present invention is to provide, in view of the problems described above, a heat induction-type fixing device capable of heating a heating body and a pressing body without increasing the number of exciting coils.

In order to accomplish the object, there is provided a fixing device in the present invention, including a heating body which has a heating heat generation section subjected to induction heating upon application of alternating magnetic fields generated by an exciting coil and which comes into contact with a printing surface side of recording paper with a toner image transferred thereto, a pressing body which has a pressing heat generation section and which comes into contact with a back surface of the recording paper, the pressing heat generation section being higher in magnetic permeability than the heating heat generation section and being subjected to induction heating by a part of magnetic flux in the alternating magnetic fields leaking from the heating heat generation section; and a drive circuit for applying drive voltage to the exciting coil, wherein a rate of the alternating magnetic fields leaking from the heating heat generation section is changed by frequencies of the drive voltage.

Metals having low magnetic permeability have a properties to generate less eddy current in the alternating magnetic fields and to transmit lines of magnetic force but to capture the lines of magnetic force as the frequency of the alternating magnetic fields increases, that is, to capture the lines of magnetic force by generating eddy current to generate heat. According to the structure, when the temperature of a heating body is increased through induction heating of the heating heat generation section with low magnetic permeability, leakage flux from the magnetic flux in the heating heat generation section increases in the case where the frequency of the alternating magnetic fields is low, and therefore it become possible to capture the leakage flux with the pressing heat generation section with large magnetic permeability so as to make the pressing heat generation section generate heat. Moreover, increasing the frequency of the alternating magnetic fields makes it possible to increase the magnetic flux captured by the heating heat generation section and to thereby reduce the leakage flux, which allows the heating heat generation section to increase a heating value.

In the fixing device of the present invention, the drive circuit may input high-frequency voltage with a specified frequency, which lowers a leakage rate of generated alternating magnetic fields from the heating heat generation section, and low-frequency voltage with a specified frequency, which increases a leakage rate of the generated alternating magnetic fields from the heating heat generation section, into the exciting coil.

According to the structure, the fixing device supports only two frequencies, which facilitates structuring the drive circuit. Since a heat generating ratio between the heating heat generation section and the pressing heat generation section is determined by the frequency of drive voltage, control thereof becomes easy.

In the fixing device of the present invention, the exciting coil may be disposed inside the heating body, and in the case where the heating body is an endless belt, the core of the exciting coil may also be used as a guide for the endless belt.

The exciting coil may be disposed outside the heating body, and a core to guide the magnetic flux leaking from the heating body to the pressing body may be disposed inside the heating body. In the case where the heating body is an endless belt, the core may also be used as a guide for the endless belt.

In the fixing device of the present invention, the drive circuit can select and output either the high-frequency voltage or the low-frequency voltage and can adjust an output time ratio between the high-frequency voltage and the low-frequency voltage, so that the circuit can be structured relatively easily.

In the fixing device of the present invention, the drive circuit can superimpose and output the high-frequency voltage and the low-frequency voltage and can adjust each amplitude of the high-frequency voltage and the low-frequency voltage, so that the heating body and the pressing body can constantly be heated.

The fixing device of the present invention includes a heating temperature sensor for detecting temperature of the heating body and a pressing temperature sensor for detecting temperature of the pressing body, wherein a relation between an output ratio between the high-frequency voltage and the low-frequency voltage and a heating value ratio between the heating body and the pressing body is stored, and wherein the output ratio between the high-frequency voltage and the low-frequency voltage of the drive circuit may be determined depending on outputs of the heating temperature sensor and the pressing temperature sensor and based on the heating value ratio.

According to the structure, when available electric power is limited, electric power introduced to heat the heating body and the pressing body is allotted at an optimum ratio so that the state allowing fixing process can be maintained for a long period of time during continuous operation with high load.

In the fixing device of present invention, a core for guiding magnetic flux leaking from the heating body to the pressing body may be disposed before and after a nip with which the heating body and the pressing body come into contact, and at least one of the cores disposed before and the after the nip may function also as a separator for separating the recording paper from the heating body or the pressing body or as a guide for guiding the recording paper.

According to the structure, the pressing body may be heated efficiently.

In the fixing device of the present invention, a frequency of the high-frequency voltage may be integral multiple of a frequency of the low-frequency voltage to facilitate structuring of the drive circuit.

In the fixing device of the present invention, the exciting coil may be disposed at a slant toward a direction of pressure contact between the heating body and the pressing body.

According to the structure, heat generation on the upstream side in a recording paper transportation direction can be increased and therefore thermal efficiency can be enhanced.

The fixing device of the present invention may include protection means for prohibiting the drive circuit from outputting the low-frequency voltage when the recording paper carries an electric component.

There is provided a fixing device of the present invention, including a first rotor which has metal at least in a part thereof and which comes into contact with a printing surface of recording paper with a toner image transferred thereto, a second rotor which has metal higher in magnetic permeability than the first rotor at least in a part thereof and which sandwiches the recording paper with the first rotor and lets the recording paper pass, an exciting coil which applies alternating magnetic fields to the first rotor for induction-heating of the metal in the first rotor while induction-heating the metal in the second rotor with alternating magnetic fields leaking from the first rotor; a drive circuit for applying drive voltage to the exciting coil and a controller for controlling a frequency of the drive voltage so a to change a rate of the alternating magnetic fields leaking from the first rotor.

The fixing device in this aspect may include a first sensor for detecting surface temperature of the first rotor and a second sensor for detecting surface temperature of the second rotor.

In the fixing device in this aspect, the control means may instruct the drive circuit to output drive voltage with a first frequency for induction heating of the first rotor and may instruct the drive circuit to output drive voltage with a second frequency lower than the first frequency for induction heating of the second rotor.

In the fixing device in this aspect, the exciting coil may be placed on an opposite side of the second rotor with respect to the first rotor so as to face the first rotor, and in this case, a core for guiding magnetic fields applied by the exciting coil is preferably disposed in the first rotor.

According to the present invention, a heating heat generation section in a heating body is structured from a material lower in magnetic permeability than a pressing heat generation section in a pressing body, so that the pressing heat generation section with high magnetic permeability can be induction-heated by the magnetic flux which leaks when the applied frequency is lowered. Therefore, the heating body and the pressing body can be selected for the induction heating with a single coil.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

The embodiments of the present invention will now be described with reference to the drawings.

Figure 1:
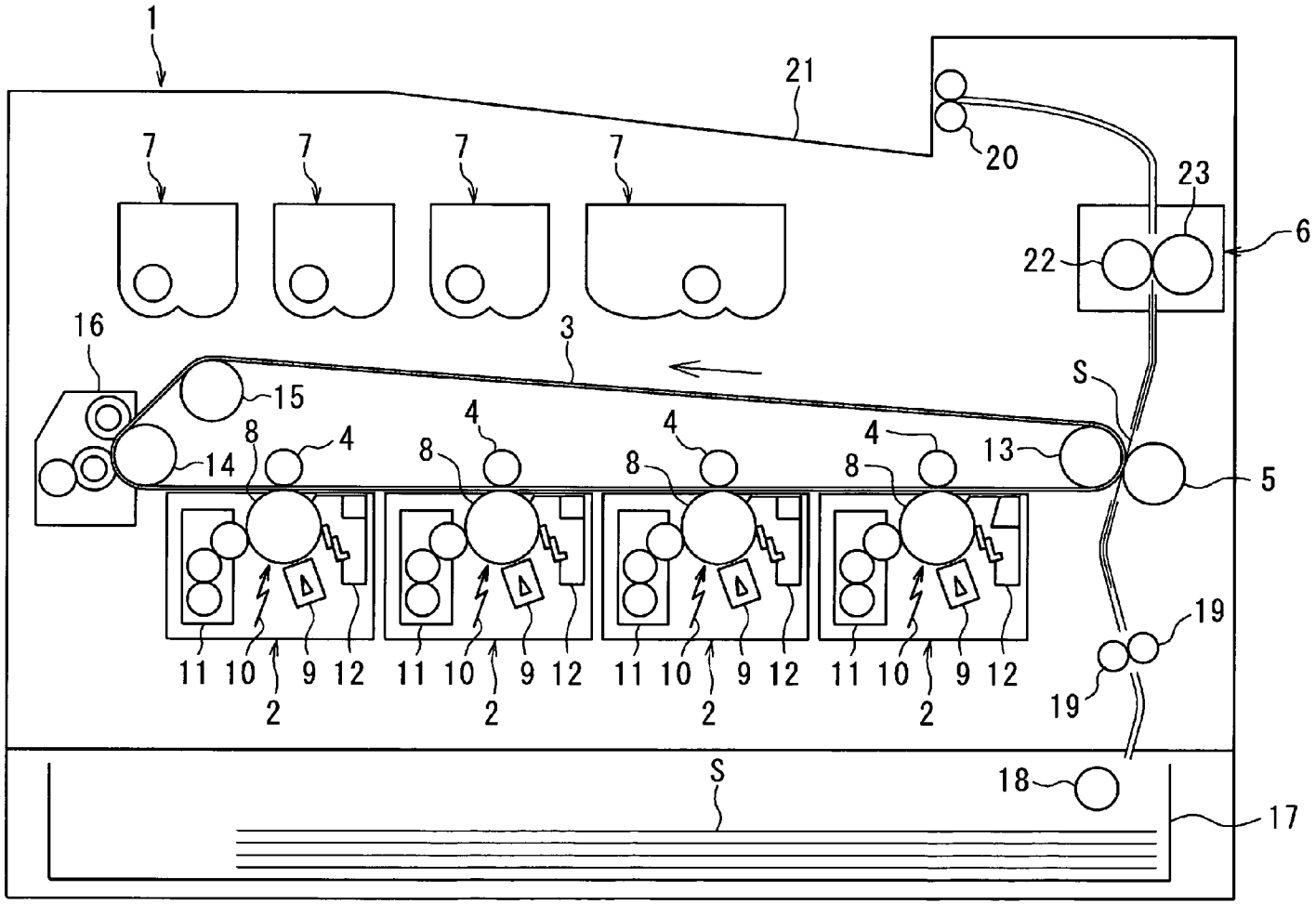
FIG. 1 is a schematic view showing an image forming apparatus having a fixing device of the present invention.

FIG. 1 shows an image forming apparatus 1 having a fixing device of the present invention. The image forming-apparatus 1 is composed of four developing units 2 for forming images with toners of yellow, magenta, cyan and black, a transfer belt 3, a primary transfer roller 4 for transferring the toner images formed by the respective developing units 2 onto the transfer belt 3 with electrostatic force, a secondary transfer roller 5 for transferring the toner images transferred onto the transfer belt 3 onto recording paper S with electrostatic force, a fixing device 6, which is a first embodiment of the present invention, for fixing the toner images by heating the recording paper S, and four toner cartridges 7 for supplying toners of yellow, magenta, cyan and black to the respective developing units 2.

The developing units 2 each have a dram-like photoconductor 8 which rotates, an charger 9 for electrifying the photoconductor 8, an exposure device 10 for exposing the electrified photoconductor 8 to form electrostatic latent images, a developer 11 for attaching toner T to the electrostatic latent images to form toner images, and a cleaner 12 for scraping the toner off the surface of the photoconductor 8.

The transfer belt 3, which is stretched over a rotationally driven drive roller 13, a driven roller 14, and a tension roller 15 for providing tension, is rotated in an arrow direction by the drive roller 13. The image forming apparatus 1 also has a cleaner unit 16 for removing the toner remaining on the surface of the transfer belt 3.

The recording paper S is fed to a paper feed section 17, sent one by one by a feed roller 18, transferred to the secondary transfer roller 5 by a transportation roller 19, and passes the fixing device 6 before being outputted to an output section 21 by an output roller 20.

Figure 2:
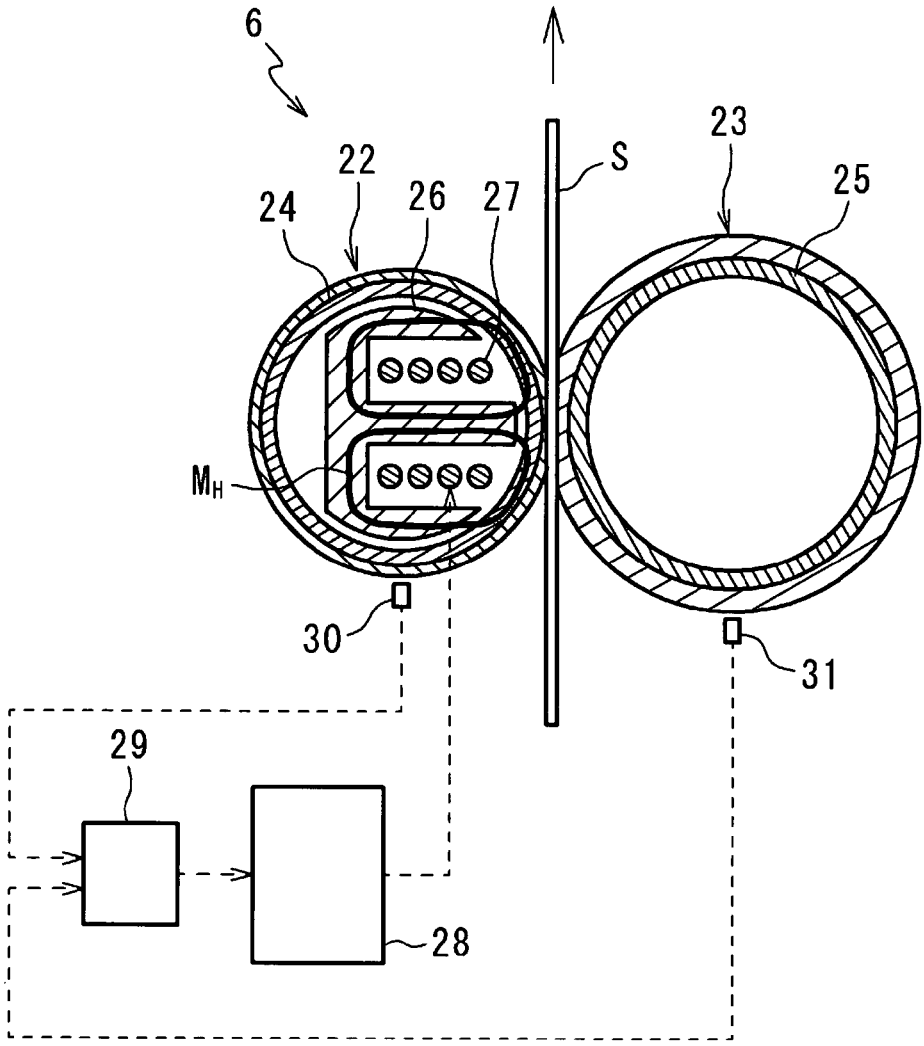
FIG. 2 is a schematic cross sectional view showing the fixing device in a first embodiment of the present invention when high-frequency voltage is applied thereto.

As described in detail in FIG. 2, the fixing device 6 has a heating roller (heating body) 22 and a pressure roller (pressing body) 23, the heating roller 22 having a shaft (heating heat generation section) 24 made of, for example, aluminum and being rotationally driven by an unshown motor. The pressure roller 23 has a shaft (pressing heat generation section) 25 made of, for example, magnetic stainless steel high in magnetic permeability than aluminum, and rotates following after rotation of the heating roller 22. An exciting coil 27 having a core 26 made of, for example, ferrite is disposed inside the heating roller 22. Drive voltage is applied to the exciting coil 27 by a drive circuit 28 which outputs high-frequency voltage with a frequency determined by a control signal inputted from a controller 29.

The core 26, which has an E-shaped cross section, is disposed inside the shaft 24 in the state of extending over generally the entire axial direction of the heating roller 22 with a space so as not to come into contact with the shaft 24. The exciting coil 27, which is formed by winding a lead wire around a crossbar section in the middle of the E-shaped portion of the core 26, is a flattened coil extending in the axial direction of the heating roller 22.

The fixing device 6 has a heating temperature sensor 30 and a pressing temperature sensor 31 for detecting the surface temperature of the heating roller 22 and the pressure roller 23. The controller 29 controls drive voltage applied by the drive circuit 28 to the exciting coil 27 in response to outputs from the heating temperature sensor 30 and the pressing temperature sensor 31 in order to control the heating roller 22 and the pressure roller 23 so as to have specified temperature.

When a high-frequency voltage with, for example, frequency f1=40 kHz is applied to the exciting coil 27, magnetic flux $M_H$ of alternating magnetic fields (high-frequency magnetic fields) formed by the exciting coil 27 is mainly captured by the core 26 and the heating heat generation section 24 made of aluminum as shown in FIG. 2. In this case, eddy current flows in a direction countering the magnetic flux $M_H$ in the heating heat generation section 24, and heat is generated by Joule loss, i.e., induction heating is made by the exciting coil 27.

The fixing device 6 puts the recording paper S in between a nip with which the heating roller 22 and the pressure roller 23 come into contact and transports the recording paper S by rotating force of the heating roller 22. A printing surface side of the recording paper S with a toner image transferred thereto comes into contact with the heating roller 22 while a back surface side with no toner image transferred thereto comes into contact with the pressure roller 23. The toner on the recording paper S is fixed onto the recording paper S through heating and pressing by the heating roller 22.

Figure 3:
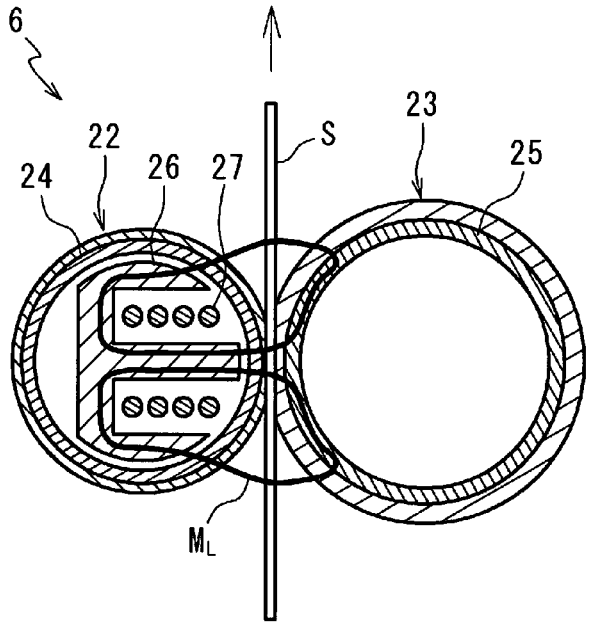
FIG. 3 is a schematic cross sectional view showing the fixing device in FIG. 2 when low-frequency voltage is applied thereto.

When a low-frequency voltage with, for example, frequency f2=1 kHz is applied to the exciting coil 27, the heating heat generation section 24 with low magnetic permeability cannot capture magnetic flux $M_L$ as shown in FIG. 3, as a result of which a large part of the magnetic flux $M_L$ leaks and is captured by the pressing heat generation section 25 with high magnetic permeability. Consequently, the alternating magnetic fields $M_L$ formed by low-frequency voltage can induction-heat the pressing heat generation section 25, while the pressure roller 23 does not cool the recording paper S heated by the heating roller 22 so as not to disturb fixing process.

Figure 4:
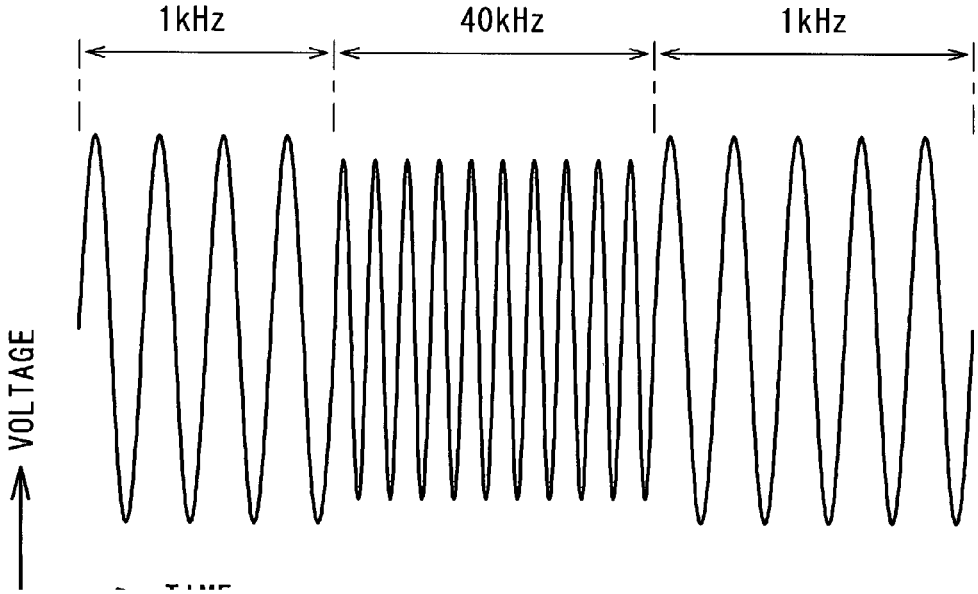
FIG. 4 is a wave form chart of a drive voltage applied to the fixing device in FIG. 2.

FIG. 4 shows output voltage of the drive circuit 28. The drive circuit 28 can switches outputs of a low-frequency voltage of 1 kHz mainly for heating the pressure roller 23 and a high-frequency voltage of 40 kHz mainly for heating the heating roller 22, for example, every several seconds.

Controlling the amplitude of the low-frequency voltage and the high-frequency voltage allows control over heating values of the heating heat generation section 24 and the pressing heat generation section 25. However, the image forming apparatus 1 has predetermined maximum power consumption and therefore power available for the fixing device 6 is limited depending on operation states. Employing a voltage control causes increased costs of the drive circuit 28. Therefore, in the image forming apparatus 1, output voltage of the drive circuit 28 is fixed, and the temperature of the heating roller 22 and the pressure roller 23 is controlled by adjusting an output time of the high-frequency voltage and the low-frequency voltage.

Figure 5:
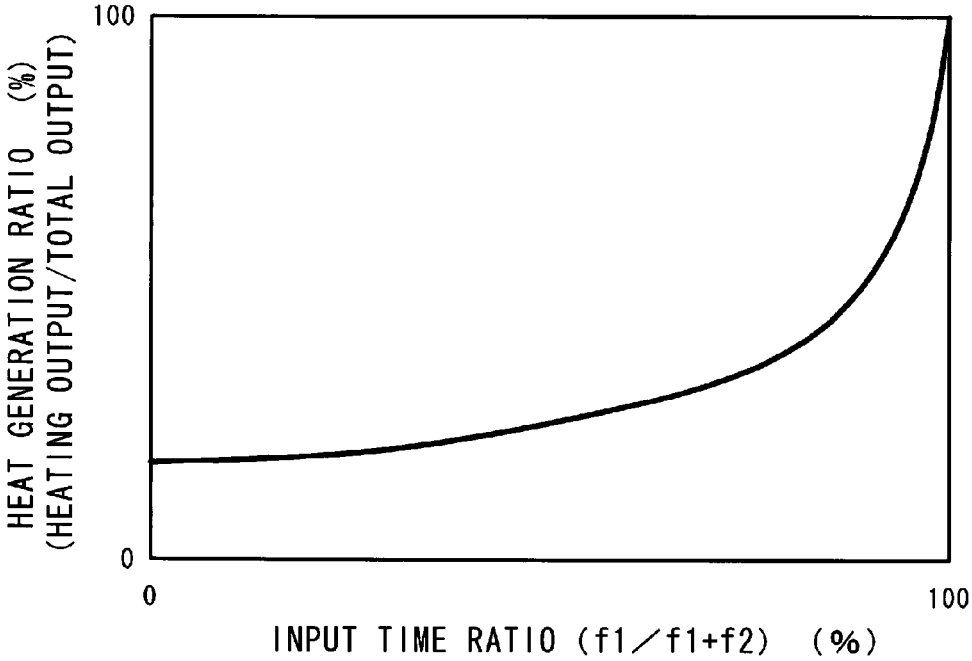
FIG. 5 is a graph view showing a relation between a drive voltage input time ratio and a heat generating ratio of the fixing device in FIG. 2.

FIG. 5 shows how heating values of the heating heat generation section 24 and the pressing heat generation section 25 change with a ratio in output time between the high-frequency voltage and the low-frequency voltage. As shown in the drawing, when the low-frequency voltage is applied, magnetic flux leaks from the heating heat generation section 24, although heat generation from the heating heat generation section 24 does not totally disappear.

The fixing device 6, which stores FIG. 5 in a numerical form as a table, calculates a ratio of heat amounts to be inputted into the heating roller 22 and the pressure roller 23 in response to outputs from the heating temperature sensor 30 and the pressing temperature sensor 31 at the time of start up or during high-load operation, and determines an optimum output time ratio between the high-frequency voltage and the low-frequency voltage based on the table showing FIG. 5 in a numerical form.

Thus, electric power inputted to heat the heating roller 22 and the pressure roller 23 can be allotted with an optimum ratio, and the state allowing fixing process can be maintained for a long period of time even during continuous operation with a high load.

Moreover, the image forming apparatus 1 in the present embodiment is so structured that whether or not recording paper S carries any electric component such as IC chips can be determined in the paper feed section 17 or in a transportation route of recording paper S, or the fact that the recording paper S carries any electric component can be recognized through input operation by operators, so that if the recording paper S carries the electric component, then a protection means provided to prevent the drive circuit 28 from outputting low-frequency voltage can prevent the electric component from being damaged by applying magnetic flux to the electric component.

Figure 6:
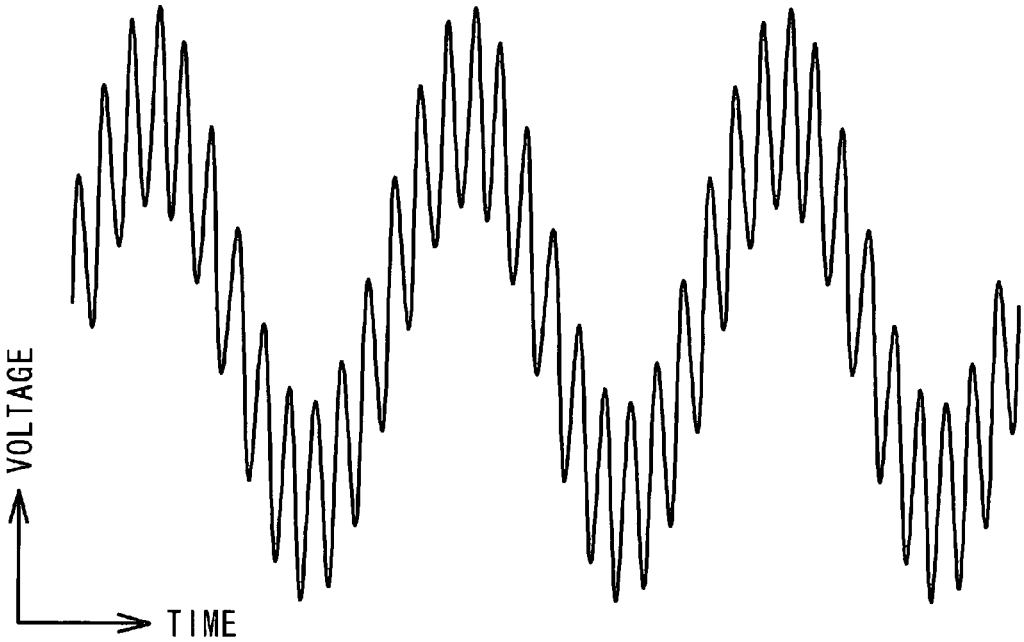
FIG. 6 is a wave form chart of an alternative of the drive voltage in FIG. 4.

As an alternative of FIG. 4, the drive voltage inputted by the drive circuit 28 into the exciting coil 27 may be a voltage obtained by superimposing high-frequency voltage with low-frequency voltage as shown in FIG. 6. In this case, heating values in the heating heat generation section 24 and the pressing heat generation section 25 are determined by the amplitude of the high-frequency voltage and the low-frequency voltage. Since available electric power is still limited, the amplitude of each of the high-frequency voltage and the low-frequency voltage should be determined based on the table showing FIG. 5 in a numerical form.

In this drive voltage wave form, if a frequency of the high-frequency voltage is integral multiple of a frequency of the low-frequency voltage, then the same wave form repeatedly appears in every cycle of the low-frequency voltage, and this is convenient for forming voltage wave forms.

Figure 7:
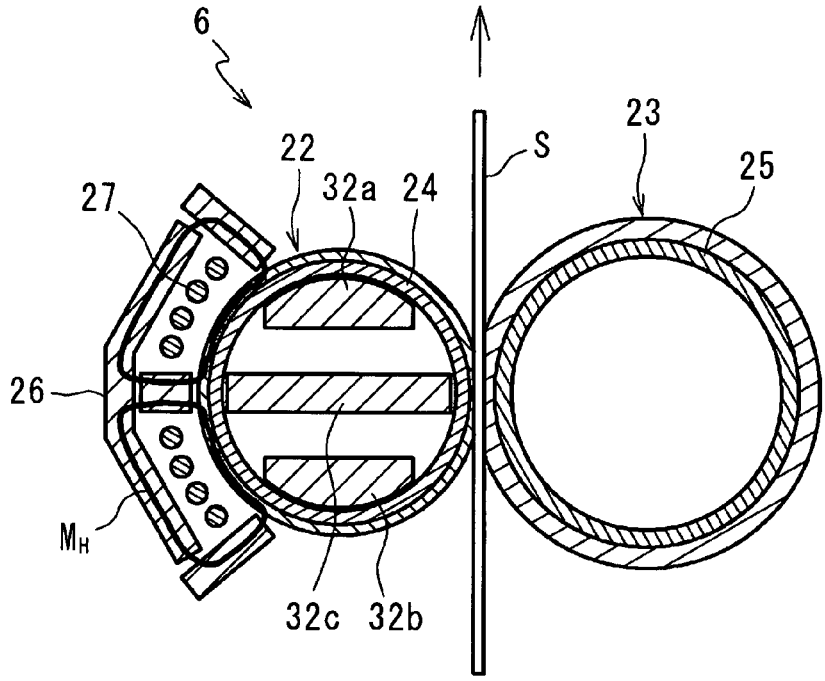
FIG. 7 is a schematic cross sectional view showing a fixing device in a second embodiment of the present invention when high-frequency voltage is applied thereto.

Further, FIG. 7 shows a fixing device 6 in a second embodiment. The fixing device 6 in the present embodiment has an exciting coil 27 having a core 26 disposed outside a heating roller 22. Distal cores 32*a*, 32*b*, 32*c* made of, for example, ferrite, are disposed inside the heating roller 22. The distal cores 32*a*, 32*b* are placed inside the heating roller 22 in the state of extending in a generally parallel direction along the inner surface of the heating roller 22 from a position near an outer peripheral section of the exciting coil 27 toward the pressure roller 23, while the distal core 32*c* is placed between the distal cores 32*a* and 32*b* in the heating roller 22 in the state of extending from a position near the central section of a winding of the exciting coil 27 toward the center of the pressure roller 23 through the heating roller 22. Since other aspects of the structure in the present embodiment are identical to those in the first embodiment, description thereof will be omitted.

In the present embodiment, when high-frequency voltage is applied to the exciting coil 27, high-frequency magnetic fields $M_H$ are generated and captured by a heating heat generation section 24 made of aluminum, by which the heating roller 22 can be heated.

Figure 8:
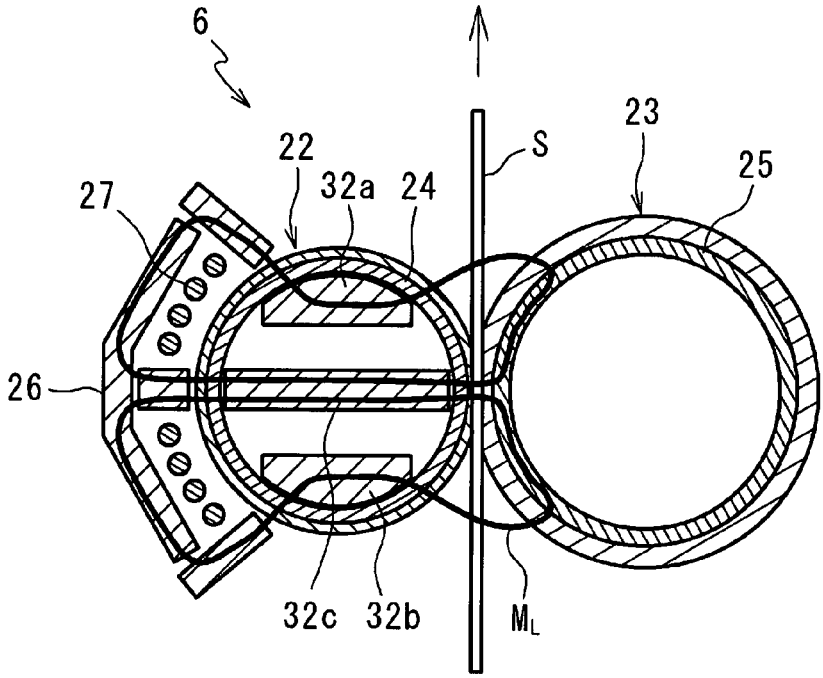
FIG. 8 is a schematic cross sectional view showing the fixing device in FIG. 7 when low-frequency voltage is applied thereto.

As shown in FIG. 8, in the present embodiment, magnetic flux $M_L$ generated when low-frequency voltage is applied to the exciting coil 27 leaks from the heating heat generation section 24, is captured by the distal cores 32*a*, 32*b*, 32*c* having high magnetic permeability and is guided to the vicinity of the pressing heat generation section 25 made of magnetic stainless steel before being captured by the pressing heat generation section 25 having high magnetic permeability. The pressing heat generation section 25 is subjected to induction heating by the magnetic flux $M_L$ leaking from the heating heat generation section 24 and ends up heating the pressure roller 23.

In the present embodiment, as shown in FIG. 7, when high-frequency voltage is applied, the exciting coil 27 heats the heating roller 22 in a position far from the nip with which the heating roller 22 and the pressure roller 23 come into contact, and as a result, thermal efficiency is slightly decreased compared to the first embodiment. However, since the exciting coil 27 is disposed outside the heating roller 22, there is an advantage that cooling by the exciting coil 27 is sufficient and a trouble is hardly caused by overheating of the exciting coil 27 is less likely to occur.

Figure 9:
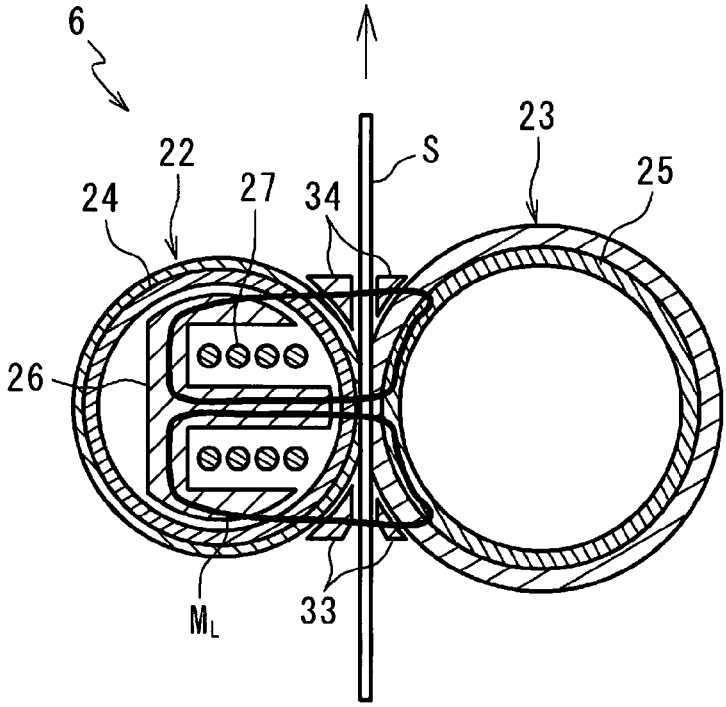
FIG. 9 is a schematic cross sectional view showing a fixing device in a third embodiment of the present invention when low-frequency voltage is applied thereto.

FIG. 9 shows a fixing device 6 in a third embodiment of the present invention. In the fixing device 6 in the present embodiment, relay cores 33, 34 made of, for example, magnetic steel plates, are respectively disposed before and after the nip, with which the heating roller 22 and the pressure roller 23 come into contact, in the way of holding recording paper S therebetween. Since other aspects of the structure in the present embodiment are identical to those in the first embodiment, description thereof will be omitted.

The relay cores 33, 34, which have a length generally identical to that of the core 26 in an axial direction of the heating roller 22 and the pressure roller 23, guide the magnetic flux $M_L$ leaking from the heating roller 22 so as to be applied in the state of concentrating onto the vicinity of the nip section of the pressing heat generation section 25 in the pressure roller 23, by which an effect of increasing thermal efficiency is implemented. Moreover, the upstream relay core 33 has also a function as a guide to guide recording paper S, while the downstream relay core 34 has also a function as a separator for separating the recording paper S from the heating roller 22 and the pressure roller 23.

Figure 10:
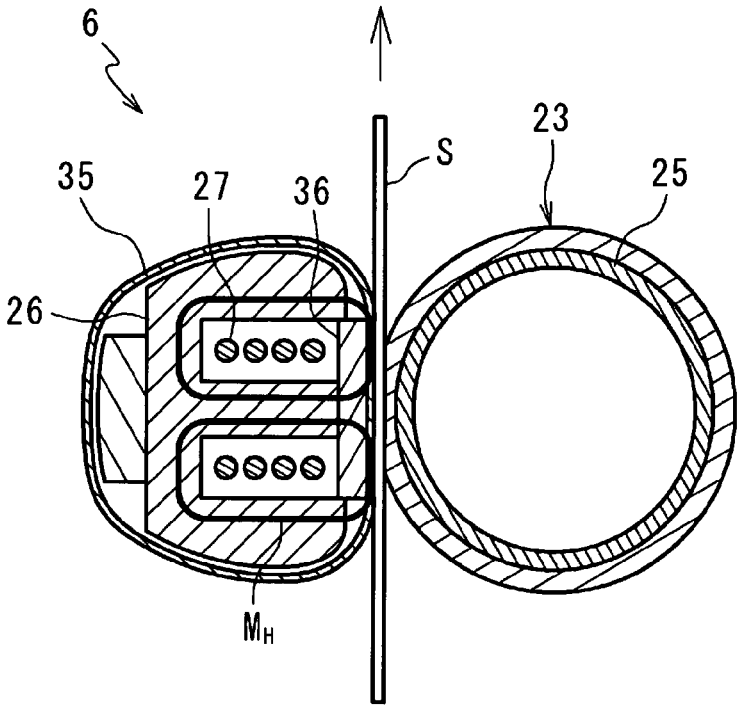
FIG. 10 is a schematic cross sectional view showing a fixing device in a fourth embodiment of the present invention when high-frequency voltage is applied thereto.

FIG. 10 shows a fixing device 6 in a fourth embodiment of the present embodiment. In the fixing device 6 in the present embodiment, a heating body which comes into contact with the printing surface side of recording paper S, is a heating belt 35 sleeved around the core 26 and composed of an endless belt made of, for example, resin laminated with aluminum. The heating belt 35 forms a nip to sandwich the recording paper S upon being pressed toward the pressure roller 23 by a pressure contact member 36 from the inside. In the present embodiment, the pressure roller 23 is rotationally driven and the heating belt 35 rotates following after the rotation of the pressure roller 23.

Also in the present embodiment, when high-frequency voltage is applied to the exciting coil 27, an aluminum layer serving as a heating heat generation section of the heating belt 35 is subjected to induction heating, whereas when low-frequency voltage is applied to the exciting coil 27, the pressing heat generation section 25 in the pressure roller 23 is subjected to induction heating.

The core 26 in the present embodiment has not only a function to guide magnetic flux generated by the exciting coil 27 but also a function as a guide for the heating belt 35.

Figure 11:
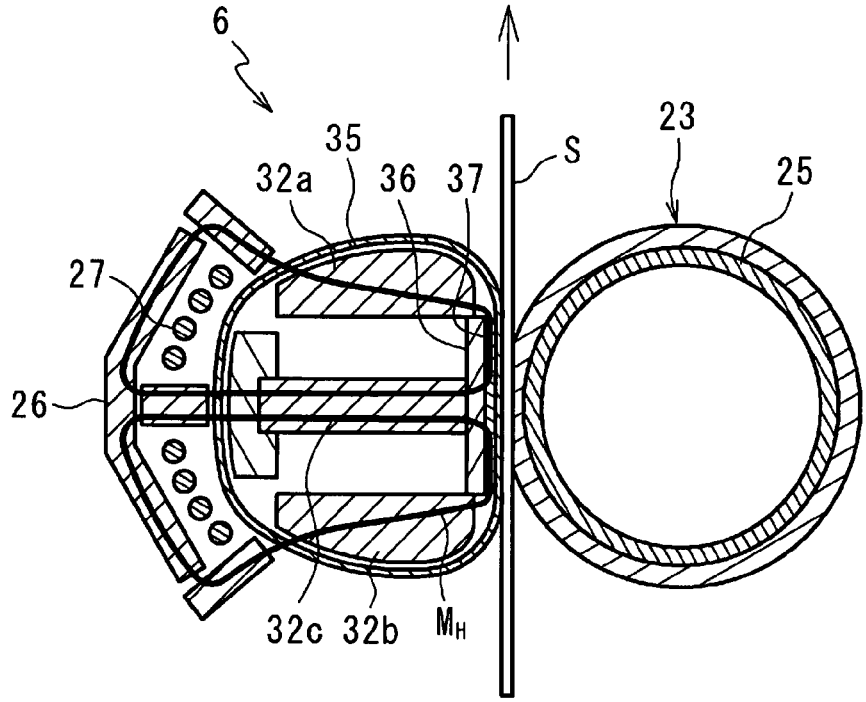
FIG. 11 is a schematic cross sectional view showing a fixing device in a fifth embodiment of the present invention when high-frequency voltage is applied thereto.

FIG. 11 shows a fixing device 6 in a fifth embodiment of the present invention. The fixing device 6 in the present embodiment, which has a heating belt 35 made of resin instead of the heating roller 22 in the second embodiment shown in FIG. 8, has a pressure contact member 36 disposed for forming a nip by pressing the heating belt 35 in the way of connecting end sections of the distal cores 32*a*, 32*b*, 32*c* on the side of the pressure roller 23, and has a heating heat generation section 37 made of aluminum disposed on the surface of the pressure contact member 36 which comes into contact with the heating belt 35. Other aspects of the structure are identical to those in the second embodiment.

In the present embodiment, magnetic flux $M_H$ generated when high-frequency voltage is applied to the exciting coil 27 is captured by the heating heat generation section 37 and as a result, the heating heat generation section 37 is subjected to induction heating, by which the heating belt 35 is indirectly heated.

Figure 12:
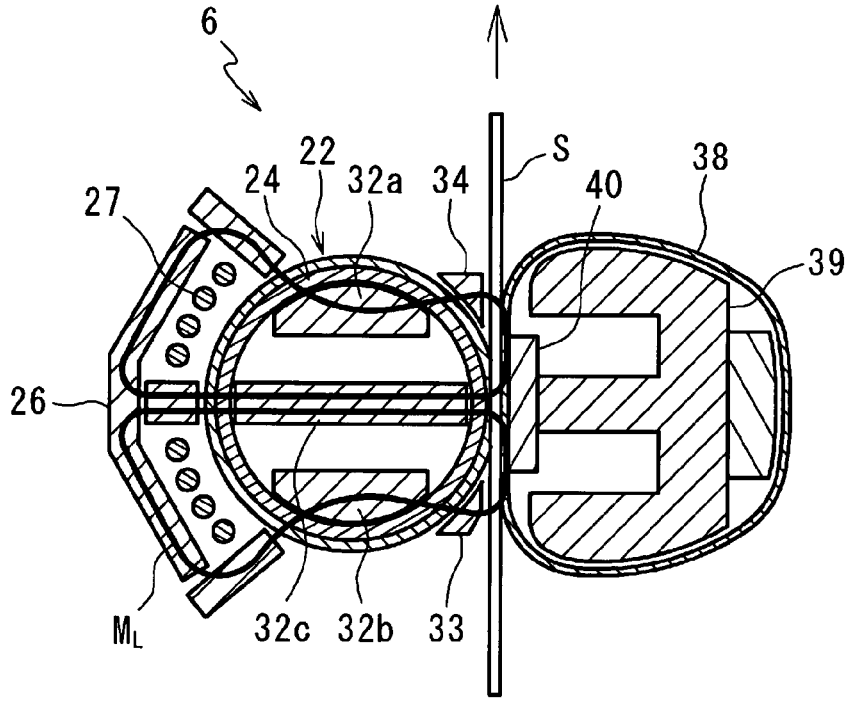
FIG. 12 is a schematic cross sectional view showing a fixing device in a sixth embodiment of the present invention when low-frequency voltage is applied thereto.

FIG. 12 shows a fixing device 6 in a sixth embodiment of the present invention. The fixing device 6 in the present embodiment is structured so that the pressure roller 23 in the second embodiment shown in FIG. 7, i.e., a heating body coming into contact with the back surface side of recording paper S, is a pressing belt 38 that is an endless belt formed, for example, by coating a stainless belt with resin. The pressing belt 38, which is sleeved around a core 39, forms a nip to sandwich recording paper S upon being pressed toward the heating roller 22 by a pressure contact member 40 from the inside. The fixing device 6 in the present embodiment has relay cores 33, 34 identical to those in the fourth embodiment shown in FIG. 9.

In the present embodiment, magnetic flux $M_L$ generated when low-frequency voltage is applied to the exciting coil 27 and leaking from the heating roller 22 is captured by a stainless layer serving as a pressing heat generation section in a pressing belt 38, and as a result, the pressing belt 38 is subjected to induction heating. Although a core 39 is to capture the magnetic flux $M_L$ in the case where the magnetic flux $M_L$ leaks from the pressing belt 38, the core 39 may be replaced with a resin guide having only a function as a guide for the pressing belt 38.

Figure 13:
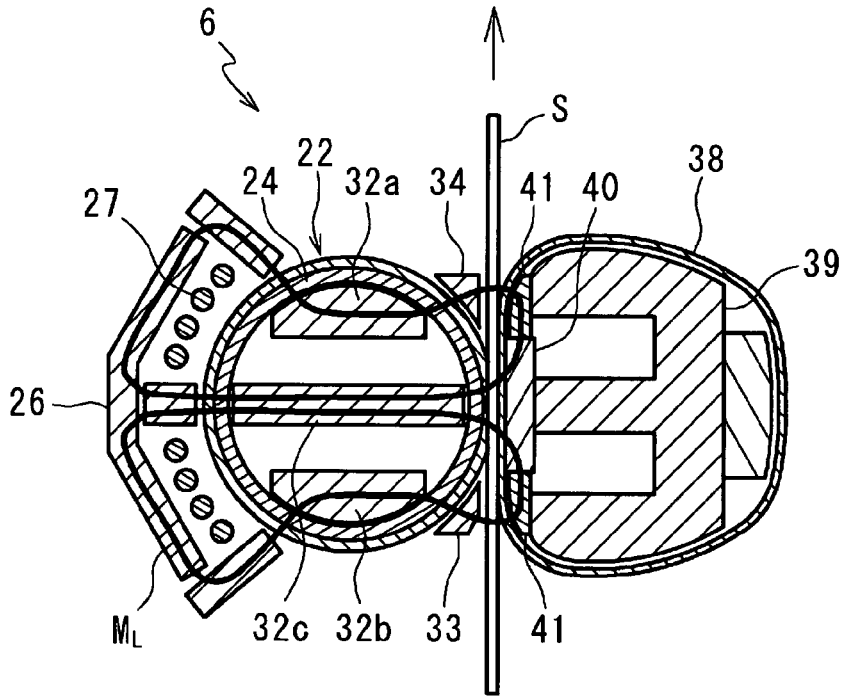
FIG. 13 is a schematic cross sectional view showing a fixing device in a seventh embodiment of the present invention when low-frequency voltage is applied thereto.

FIG. 13 shows a fixing device 6 in a seventh embodiment of the present invention. The fixing device 6 in the present embodiment is structured so that the pressing belt 38 in the fixing device in the sixth embodiment shown in FIG. 12 is an endless belt made of resin without a metal layer (pressing heat generation section) subjected to induction heating and that a pressing heat generation section 41 made of, for example, nickel is disposed before and after the pressure contact member 40 for forming a nip in a paper passing direction.

In the present embodiment, magnetic flux $M_L$ generated when low-frequency voltage is applied to the exciting coil 27 induction-heats a pressing heat generation section 41 and indirectly heat a pressing belt 38.

Figure 14:
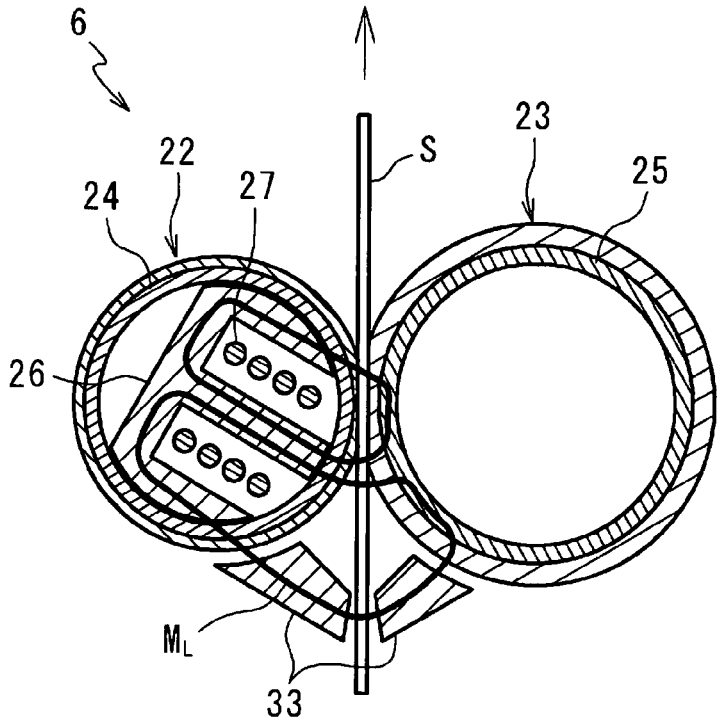
FIG. 14 is a schematic cross sectional view showing a fixing device in an eighth embodiment of the present invention when low-frequency voltage is applied thereto.

FIG. 14 shows a fixing device 6 in an eighth embodiment of the present invention. The fixing device 6 in the present embodiment has the exciting coil 27 having a core 26 in the fixing device 6 in the first embodiment shown in FIG. 2 disposed at a slant toward the upstream of the paper passing direction with respect to the direction of pressure contact between the heating roller 22 and the pressure roller 23. The fixing device 6 in the present embodiment has a relay core 33 disposed only on the upstream to the paper passing direction of the recording paper S so as to hold recording paper S therebetween.

Since the exciting coil 27 is at a slant, magnetic flux generated by the exciting coil 27 is unevenly distributed on the upstream side of the nip section of the heating-roller 22 or the pressure roller 23 and is captured in this state (low-frequency magnetic flux $M_L$ is shown in the drawing). This makes it possible to heat the upstream side of the nip section of the heating roller 22 and the pressure roller 23 and to thereby increase the efficiency to transmit heat to the recording paper S. In the case where the exciting coil 27 forms high-frequency magnetic flux, the nip section of the heating heat generation section 24 and the upstream-side section thereof capture most part of the high-frequency magnetic flux and thereby generate heat, whereas the pressing heat generation section 25 scarcely generates heat.

Figure 15:
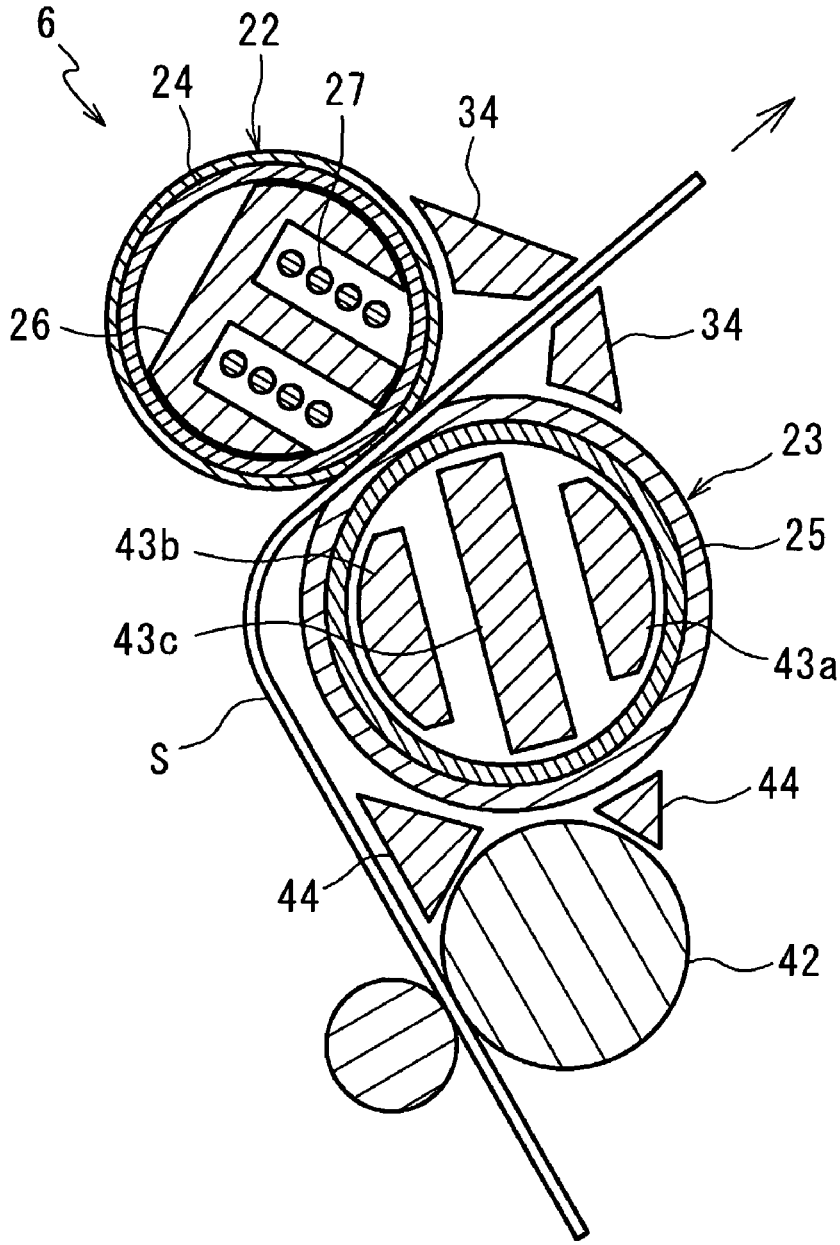
FIG. 15 is a schematic cross sectional view showing a fixing device in a ninth embodiment of the present invention when low-frequency voltage is applied thereto.

FIG. 15 shows a fixing device 6 in a ninth embodiment of the present invention. The fixing device 6 in the present embodiment is composed of a heating roller 22 having a heating heat generation section 24 made of, for example, aluminum, a pressure roller 23 having a pressing heat generation section 25 made of, for example, nickel, and a pre-heat roller 42 made of, for example, permalloy provided on the further upstream side. In the present embodiment, an exciting coil 27 having a core 26 is disposed at a slant toward the downstream side of paper passing direction with respect to the direction of pressure contact between the heating roller 22 and the pressure roller 23. In order to guide magnetic flux leaking from the pressing heat generation section 25 to the pre-heat roller 42, internal cores 43*a*, 43*b*, 43*c* having the same structure with the distal cores 32*a*, 32*b*, 32*c* in the second embodiment shown in FIG. 7 are provided in the pressure roller 23, and further, in order to guide the magnetic flux, which is guided by the internal cores 43*a*, 43*b* and further goes through the pressing heat generation section 25, to the pre-heat roller 42, an external core 44 is disposed between the pressure roller 23 and the pre-heat roller 42.

In the present embodiment, when high-frequency voltage is applied to the exciting coil 27, it becomes possible not only to make the pressing heat generation section 25 generate heat but also to further capture the magnetic flux leaking from the pressing heat generation section 25 by the pre-heat roller 42 so as to make the pre-heat roller 42 generate heat. Consequently, preheating of the recording paper S can be performed so as to ensure fixing of toner by the heating roller 22 and the pressure roller 23.

The fixing device in the present invention described in conjunction with the embodiments disclosed hereinbefore can apply alternating magnetic fields to a heating heat generation section with low magnetic permeability made of a materials such as aluminum for induction heating of the heating heat generation section and can catch the magnetic flux leaking from the heating heat generation section by means of a pressing heat generation section with high magnetic permeability made of a material such as magnetic stainless steel so that the pressing heat generation section can also generate heat.

In this case, the higher the frequency of alternating magnetic fields applied to the heating heat generation section becomes, the more the rate of magnetic flux captured by the heating heat generation section increases and the smaller the number of magnetic flux lines applied to the heating heat generation section becomes. In other words, the higher frequency of drive voltage applied to the exciting coil increases the ratio of a heating value in the heating heat generation section to a heating value in the pressing heat generation section.

In induction heating, when current values of exciting coils are the same, the higher the frequency becomes, the more the heating value increases. To put it the other way around, in order to gain large heating values with low frequency, current values should be increased. Therefore, it is difficult to make the pressing heat generation section sufficiently generate heat with frequencies which are low enough to mostly prevent the heating heat generation section from generating heat. In other words, in order to gain an effective heating value in the pressing heat generating body, drive voltage with a frequency which concurrently makes the heating heat generation section generate heat should be applied.

When the drive circuit is a high-frequency generator which can arbitrarily set frequencies, it becomes possible to select an optimum rate of heating values by changing the frequency of the drive voltage based on temperature of the heating body and the pressing body so as to maintain the heating body and the pressing body at appropriate temperature.

Therefore, the high-frequency voltage and the low-frequency voltage inputted into the exciting coil in the present invention are not limited to those of fixed frequencies but may be drive voltage of a plurality of fixed frequencies or drive voltage which can continuously change its frequencies.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An fixing device, comprising:

a heating body which has a heating heat generation section subjected to induction heating upon application of alternating magnetic fields generated by an exciting coil and which comes into contact with a printing surface side of recording paper with a toner image transferred thereto;

a pressing body which has a pressing heat generation section and which comes into contact with a back surface of the recording paper, the pressing heat generation section being higher in magnetic permeability than the heating heat generation section and being subjected to induction heating by a part of magnetic flux in the alternating magnetic fields leaking from the heating heat generation section; and a drive circuit for applying drive voltage to the exciting coil, wherein a rate of the alternating magnetic fields leaking from the heating heat generation section is changed by frequencies of the drive voltage; and wherein the drive circuit inputs a high-frequency voltage with a specified frequency, which lowers a leakage rate of generated alternating magnetic fields from the heating heat generation section, and a low-frequency voltage a specified frequency, which increases a leakage rate of the generated alternating magnetic fields from the heating heat generation section, into the exciting coil.

2. The fixing device according to claim 1, wherein the drive circuit can select and output either the high-frequency voltage or the low-frequency voltage and can adjust an output time ratio between the high-frequency voltage and the low-frequency voltage.

3. The fixing device according to claim 1, wherein the drive circuit can superimpose and output the high-frequency voltage and the low-frequency voltage and can adjust each amplitude of the high-frequency voltage and the low-frequency voltage.

4. The fixing device according to claim 1, comprising:

a heating temperature sensor for detecting temperature of the heating body; and a pressing temperature sensor for detecting temperature of the pressing body, wherein a relation between an output ratio between the high-frequency voltage and the low-frequency voltage and a heating value ratio between the heating body and the pressing body is stored, and wherein the output ratio between the high-frequency voltage and the low-frequency voltage of the drive circuit is determined depending on outputs of the heating temperature sensor and the pressing temperature sensor and based on the heating value ratio.

5. The fixing device according to claim 1, wherein a frequency of the high-frequency voltage is integral multiple of a frequency of the low-frequency voltage.

6. The fixing device according to claim 1, wherein the drive circuit does not output the low-frequency voltage in the case where the recording paper carries any electric component.

7. The fixing device according to claim 1, wherein the exciting coil is disposed inside the heating body.

8. The fixing device according to claim 7, wherein the heating body is an endless belt, wherein a core is provided in a vicinity of the exciting coil, and wherein the core functions also as a guide for the endless belt.

9. The fixing device according to claim 1, wherein the exciting coil is disposed outside the heating body.

10. The fixing device according to claim 9, wherein a core for guiding magnetic flux leaking from the heating body to the pressing body is disposed inside the heating body.

11. The fixing device according to claim 10, wherein the heating body is an endless belt, and wherein the core functions also as a guide for the endless belt.

12. The fixing device according to claim 1, wherein a core for guiding magnetic flux leaking from the heating body to the pressing body is disposed before and after a nip with which the heating body and the pressing body come into contact.

13. The fixing device according to claim 12, wherein at least one of the cores disposed before and after the nip functions also as a separator for separating the recording paper from the heating body or the pressing body.

14. The fixing device according to claim 12, wherein at least one of the cores disposed before and after the nip functions also as a guide to guide the recording paper.

15. The fixing device according to claim 1, wherein the exciting coil is disposed at a slant toward a direction of pressure contact between the heating body and the pressing body.

16. A fixing device, comprising:

a first rotor which has metal at least in a part thereof and which comes into contact with a printing surface side of recording paper with a toner image transferred thereto;

a second rotor which has metal higher in magnetic permeability than the first rotor at least in a part thereof and which sandwiches the recording paper with the first rotor and lets the recording paper pass;

an exciting coil which applies alternating magnetic fields to the first rotor for induction heating of the metal in the first rotor while induction-heating the metal in the second rotor with alternating magnetic fields leaking from the first rotor;

a drive circuit for applying drive voltage to the exciting coil; and a controller for controlling a frequency of the drive voltage so a to change a rate of the alternating magnetic fields leaking from the first rotor.

17. The fixing device according to claim 16, comprising:

a first sensor for detecting surface temperature of the first rotor; and a second sensor for detecting surface temperature of the second rotor.

18. The fixing device according to claim 16, wherein the control means instructs the drive circuit to output drive voltage with a first frequency for induction heating of the first rotor and instructs the drive circuit to output drive voltage with a second frequency lower than the first frequency for induction heating of the second rotor.

19. The fixing device according to claim 16, wherein the exciting coil is placed on an opposite side of the second rotor with respect to the first rotor so as to face the first rotor.

20. The fixing device according to claim 19, wherein a core for guiding magnetic fields applied by the exciting coil is disposed in the first rotor.

* * * * *